US005445131A

United States Patent [19]

Kusunoki et al.

[11] Patent Number: 5,445,131

[45] Date of Patent: Aug. 29, 1995

[54] FUEL CONTROL SYSTEM FOR ENGINE

[75] Inventors: Hideki Kusunoki; Masaki Fujii; Hideki Kobayashi, all of Hiroshima, Japan

[73] Assignee: Mazda Motor Corporation, Hiroshima, Japan

[21] Appl. No.: 212,886

[22] Filed: Mar. 14, 1994

[30] Foreign Application Priority Data

Mar. 12, 1993 [JP] Japan ..... 5-052395

[51] Int. Cl.[6] ..... F02D 41/12

[52] U.S. Cl. ..... 123/493

[58] Field of Search ..... 123/325, 326, 493

[56] References Cited

U.S. PATENT DOCUMENTS

| | | | |
|---|---|---|---|
| 4,565,174 | 1/1986 | Suzuki et al. | 123/493 |
| 4,597,370 | 7/1986 | Yasuoka et al. | 123/493 |
| 4,696,278 | 9/1987 | Ito et al. | 123/493 |
| 4,896,644 | 1/1990 | Kato | 123/493 |
| 4,949,693 | 8/1990 | Sonoda | 123/493 |
| 4,951,635 | 8/1990 | Nakaniwa et al. | 123/493 |
| 4,995,366 | 2/1991 | Manaka et al. | 123/493 |
| 5,035,225 | 7/1991 | Mizukoshi | 123/493 |
| 5,181,496 | 1/1993 | Kojima | 123/493 |
| 5,224,454 | 7/1993 | Miyashita et al. | 123/493 |
| 5,241,939 | 9/1993 | Nonaka | 123/493 |

FOREIGN PATENT DOCUMENTS 59-5839 1/1984 Japan .

*Primary Examiner*—Willis R. Wolfe

*Attorney, Agent, or Firm*—Keck, Mahin & Cate

[57] ABSTRACT

A fuel control system causes a fuel injector to interrupt fuel injection during a continuous decrease in engine speed to a lower limit of a hysteresis range for fuel supply/fuel interruption and to resume the interruption of fuel supply after a continuous increase in engine speed beyond an upper limit of the hysteresis range and further causes a compulsory interruption of fuel supply when a transition of the engine from non-deceleration to deceleration while the engine operates at speeds between the lower and upper limits of the hysteresis range.

4 Claims, 3 Drawing Sheets

FUEL CONTROL SYSTEM FOR ENGINE

BACKGROUND OF THE INVENTION

1. Field of the Invention

The present invention relates to a fuel control system for an engine, and, more particularly, to a fuel control system for an automobile internal combustion engine designed to improve fuel consumption by stopping the supply of fuel when the engine is decelerating.

2. Description of Related Art

Known fuel control systems for internal combustion engines which stop the supply of fuel during deceleration are characterized by a hysteresis region of rotational speeds of engine in which the supply of fuel to the engine is cut off during deceleration, such that the fuel control system cuts off the supply of fuel until the engine decreases its rotational speed below the lower limit of the hysteresis region, and also cuts off the supply of fuel when the engine increases its rotational speed above the upper limit of the hysteresis region. Such a fuel control system is known from, for example, Japanese Unexamined Patent Publication No. 59-5839.

In order for, in particular, automotive vehicles equipped with automatic transmissions, to ensure the prevention of hunting between the supply of fuel and the cut-off of fuel, the fuel control system is characterized by a wide hysteresis region of rotational speeds. This is because an engine of this kind is connected to the associated automatic transmission via a torque converter resulting in considerable changes in rotational speed.

With such a conventional fuel control system, when the rotational speed of engine has dropped below the lower limit of the hysteresis region, the cut-off of fuel is not resumed again until the rotational speed of engine rises above the upper limit of hysteresis region. Therefore, for example, even if the engine is decelerated during supplying of fuel to the engine in the hysteresis region of engine rotational speeds, if the engine does not experience much of an increase in rotational speed while the vehicle is running at a very low speed, the cut-off of fuel does not occur, and this results in an unsatisfactory increase in fuel efficiency.

SUMMARY OF THE INVENTION

It is an object of the present invention to provide a fuel control system that cuts off the supply of fuel during deceleration of an engine, even in the hysteresis region of rotational speeds, by setting more determinative conditions under which the supply of fuel is cut off, thereby improving fuel efficiency.

The above object of the present invention will be accomplished by providing a fuel control system, for an automobile internal combustion engine having a fuel supply means which supplies a fuel to the internal combustion engine, which causes the fuel supply means to continue an interruption of fuel supply during a continuous decrease in rotational speed of the engine to a lower limit of a hysteresis range regarding fuel supply/cut-off of engine speeds, and to resume the interruption of fuel supply after a continuous increase in engine speed of the engine to a lower limit of the hysteresis range. This novel engine fuel control system causes a fuel supply means compulsorily to make the interruption of fuel supply when a transition from non-deceleration to deceleration of the engine is detected while the rotational speed of engine is between the lower and upper limits of the hysteresis range of engine speeds.

With the engine fuel control system of this invention, when the vehicle is traveling at very low speeds between the upper and lower limits of engine speeds of the hysteresis region, for any deceleration of the engine during the supply of fuel, the supply of fuel is forcibly or compulsorily cut off or interrupted until the engine speed drops below the lower limit of the hysteresis range of engine speeds. By means of this compulsory interruption or cut-off of fuel supply during deceleration of the engine, even within the hysteresis region of engine speeds, substantial improvements are realized in fuel consumption efficiency.

BRIEF DESCRIPTION OF THE DRAWINGS

Above and other objects and feature of the present invention will be clearly understood from the following description directed to a preferred embodiment thereof when considered in conjunction with the accompanying drawings, in which.

DETAILED DESCRIPTION OF THE PREFERRED EMBODIMENT

Figure 1:
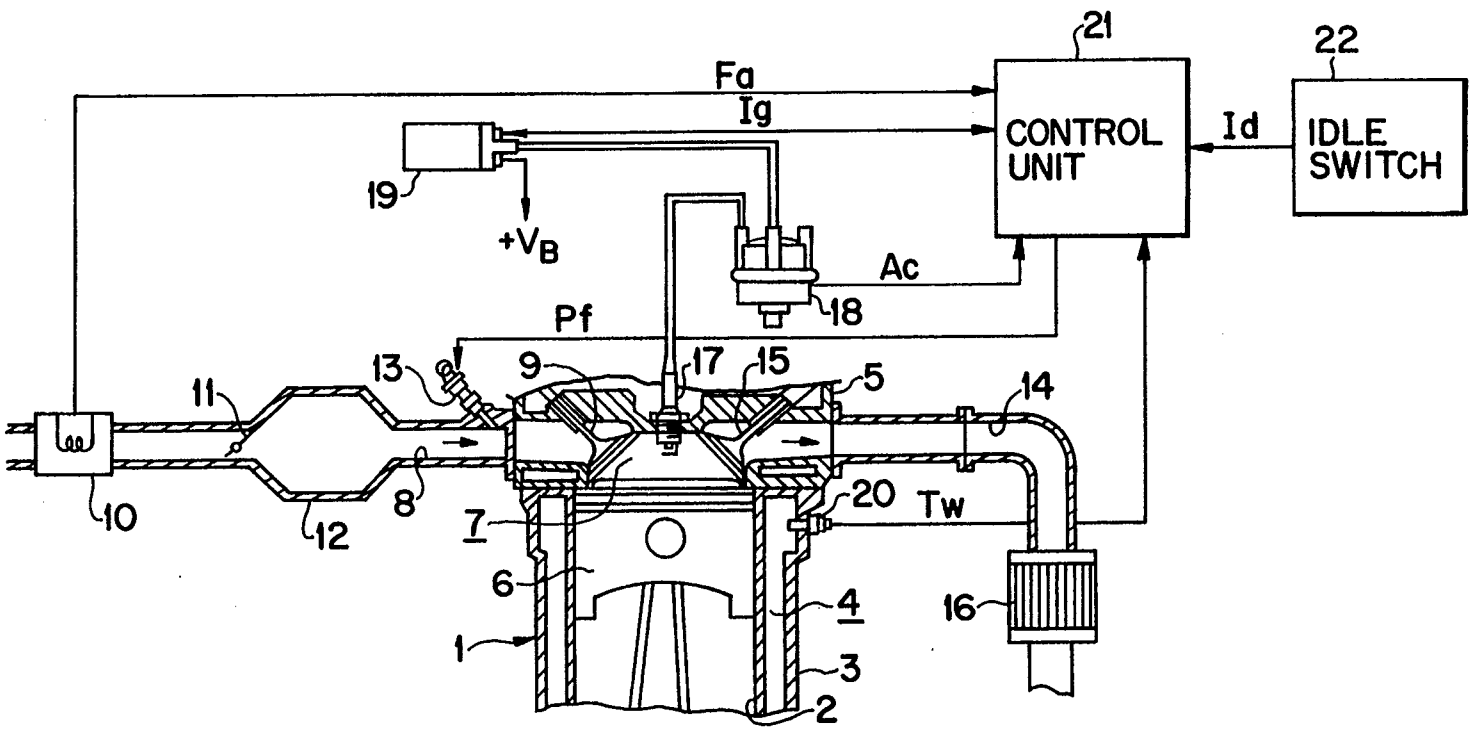
FIG. 1 is a schematic illustration showing the overall configuration of an internal combustion engine equipped with a fuel control system in accordance with a preferred embodiment of the present invention.

Referring to the drawings in detail, and in particular, to FIG. 1 showing the overall structure of an engine equipped with a fuel control system in accordance with a preferred embodiment of the present invention, the internal combustion engine 1 is comprised by a cylinder block 3 formed with cylinders 2 (only one of which is shown) and a cylinder head 5 placed on the top of the cylinder block 3. A piston 6 is reciprocally forced up and down in each of the cylinders 2. A combustion chamber 7 is formed between the piston 6, a conically-shaped bottom surface of the cylinder head 5 and a cylindrical wall of each of the cylinders 2.

An intake line 8, which is opened to the combustion chamber 7 so as to supplied air into the combustion chamber 7, is opened and closed by an intake valve 9. The intake line 8 is provided in order from the upstream side with an air flow sensor 10 for detecting the amount of intake air introduced into the intake line 8, a throttle valve 11 for restricting the effective air flow area of the air intake line 8, a surge tank 12, and an injector 13 for injecting fuel into the intake line 8. An exhaust line 14, which is opened to the combustion chamber 7 so as to discharge exhaust gases from the combustion chamber 7, is opened and closed by an exhaust valve 15. This exhaust line 14 is provided with a catalytic converter 16 that cleans the exhaust gases. The combustion chamber 7 is provided with a sparkplug 17 which is connected to an ignition coil 19 via an distributor 18 and provides an ignition spark to a fuel mixture within the combustion chamber 7. The cylinder block 3 is provided with a temperature sensor 20 so as to detects the temperature of a coolant water inside the water jacket 4 surrounding the cylinder block 3. all of these sensors are well known and may take any type well known to those skilled in the art.

The injector 13 injects a fuel into the combustion chamber 7 upon receiving of a fuel injection signal from a control unit 21 which will be described in detail later. The ignition coil 19 is designed and adapted to provide a high voltage $V_B$ to the spark plug 17 upon receiving of an ignition signal Ig from the control unit 21. The control unit 21 receives various control signals, such as an air flow signal Fa provided by the air flow sensor 10, a cranking angle signal Ac from the distributor 18, a coolant temperature signal Tw from the temperature sensor 20, and an idle signal Id, indicating that the throttle valve 11 is completely closed, from an idle switch 22. The control unit 21, mainly comprising a microcomputer, provides a fuel injection pulse signal Pf and performs the fuel cut-off or fuel supply interruption control for the injector 13.

Figure 2:
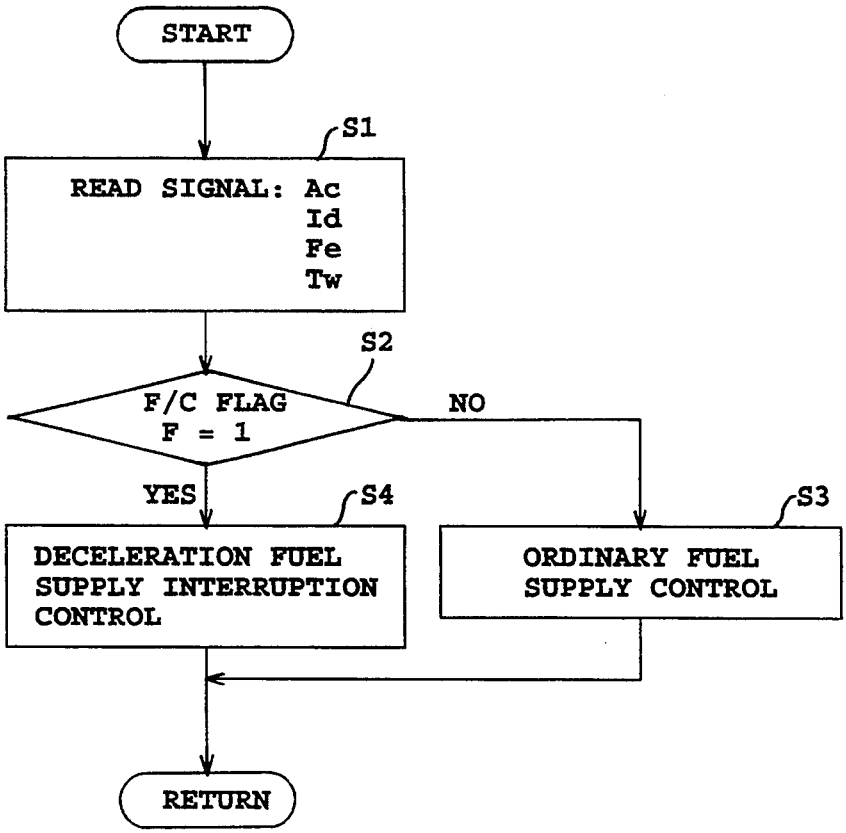
FIG. 2 is a flow chart illustrating the fuel control routine for a microcomputer of a control unit.

Referring to FIG. 2, which is a flow chart illustrating the fuel injection control sequence routine, when the flow chart sequence commences, control passes directly to step S1 where the control signals Fa, Ac, Tw and Id are read in. Then, a decision is made at step S2 as to whether or not a deceleration fuel cut-off flag F has been set to the state of "1". When the answer to the decision is "NO," this indicates that the engine 1 is operating out of conditions for the fuel cut-off or fuel supply interruption control during deceleration of the engine 1, then, at step S3, the ordinary fuel injection control is executed according to operating conditions of the engine 1 which are ascertained from the rotational speed of engine Ne, computed on the basis of the crank angle Ac detected by the distributor 18, and the engine load, obtained based on the air flow rate detected by the air flow sensor 10. After the execution of the fuel injection control, the sequence returns. On the other hand, when the answer to the decision is "YES," this indicates that the engine operating condition is proper to the execution of the deceleration fuel cut-off or fuel supply interruption control, then, at step S4, the deceleration fuel cut-off or fuel supply interruption control is executed, following which the sequence returns.

Figure 3:
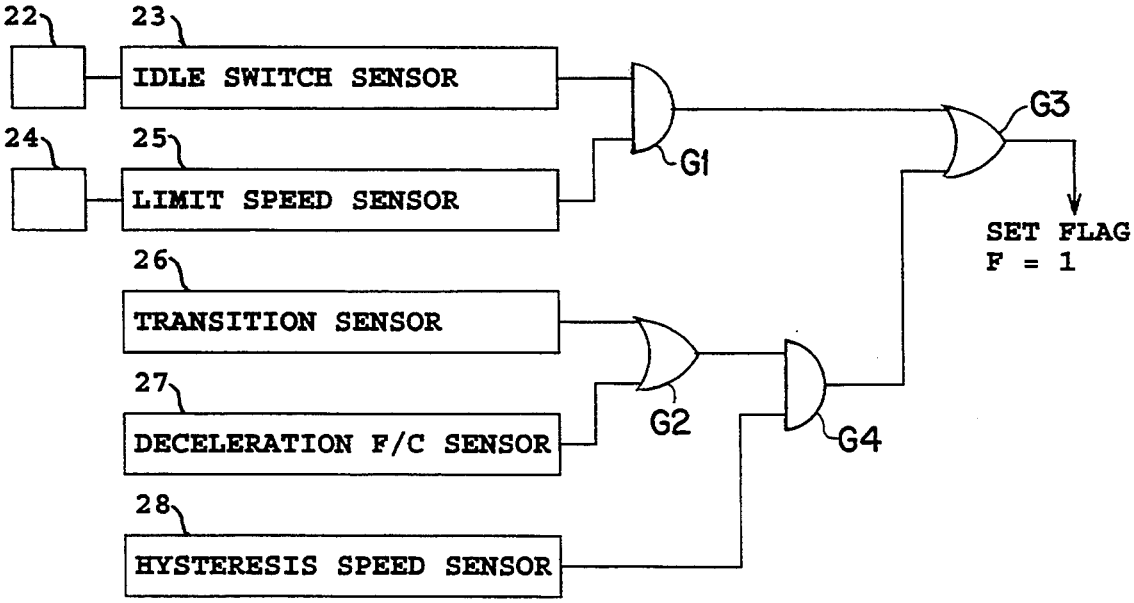
FIG. 3 is a diagram showing setting conditions of a deceleration fuel cut-off flag.
Figure 4:
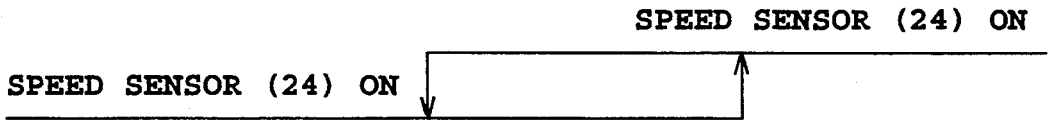
FIG. 4 is a diagram showing the operation of speed switch incorporated in the control unit.
Figure 5:
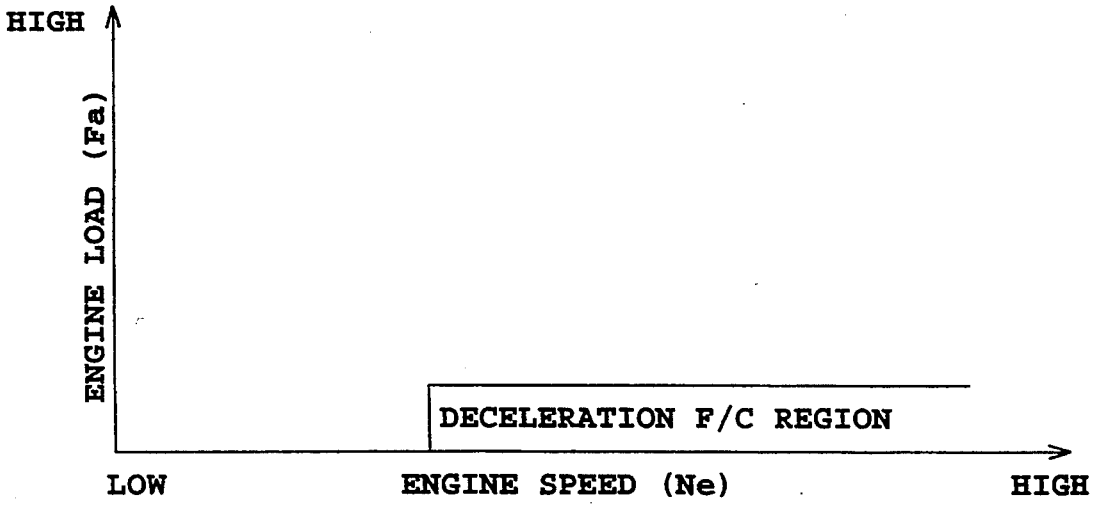
FIG. 5 is a diagram showing a region in which the interruption of fuel supply takes place.

Setting of the deceleration fuel cut-off flag F to the state of "1" is accomplished under the conditions shown in FIG. 3. In this instance, the deceleration fuel cut-off (F/C) flag F is set to the state of "1" when "Hi" signals are output from both idle switch sensor 23 and limit speed sensor 25. This condition is detected by, for instance, an AND gate G1 and the result of detection sets the deceleration fuel cut-off (F/C) flag F to the state of "1" through an OR gate G3. The idle switch sensor 23 provides a "Hi" signal only when the idle switch 22 is turned "ON" as a result of the throttle valve 11 being completely closed or is shifted into its idle position. Because shifting of the throttle valve 11 to the idle position is caused by releasing of an accelerator pedal (not shown), the idle switch 22 may be replaced by a switch which is turned "ON" when the accelerator pedal is completely released. The limit speed sensor 25 provides a "Hi" signal only when a speed switch 24, which is incorporated in the control unit 21, remains turned "ON". As shown in FIG. 4, the speed switch 24 remains turned "ON" during a decrease in engine speed Ne down to the lower limit of the hysteresis region of rotational speed NL, for example 1,000 rpm, and remains, conversely, turned "OFF" during an increase in engine speed up to the upper limit of the hysteresis region of rotational speed NH, for example 1,600 rpm. In other words, the setting of the deceleration fuel cut-off (F/C) flag F to the state of "1" is performed when the engine 1 is operating in the deceleration fuel cut-off (F/C) region, as shown in FIG. 5.

In addition, the deceleration fuel cut-off (F/C) flag F is also set to the state "1" when "Hi" signals are provided from both transition sensor 26 and hysteresis speed sensor 28 or when "Hi" signals are provided from both deceleration fuel cut-off (F/C) sensor 27 and hysteresis speed sensor 28. These conditions are detected by, for instance, the combination of an OR gate G2 and an AND gate G4 and the result of detection sets the deceleration fuel cut-off (F/C) flag F to the state of "1" through the OR gate G3. The transition sensor 26 provides the "Hi" signal when there is caused a transition of the engine 1 from non-deceleration to deceleration or vise versa. Such a transition is caused by depressing or releasing of an accelerator pedal (not shown) and detected from a transition of the idle switch 22 between turned "ON" and "OFF." The deceleration fuel cut-off sensor 27, which is incorporated in the microcomputer of the control unit 21, provides the "Hi" signal if the deceleration fuel cut-off or fuel supply interruption control has previously been conducted or performed. The hysteresis speed sensor 28, which is incorporated in the microcomputer of the control unit 21, provides the "Hi" signal when an engine speed Ne is greater than the lower rotational speed NL (1,000 rpm) of the hysteresis region. In this instance, the setting of the deceleration fuel cut-off (F/C) flag F to the state "1" is performed only when the engine 1 is decelerating due to releasing of the accelerator pedal, while, after the fuel cut-off or fuel supply interruption has previously been conducted, the engine 1 operates at speeds Ne within the hysteresis region of engine speeds, defined between the lower limit NL and the upper limit NH, and the supply of fuel is conducted effectively. Accordingly, when the engine 1 is operating in the deceleration fuel cut-off (F/C) region shown in FIG. 5 during decelerating, the injector 13 is caused compulsorily to interrupt fuel injection, thereby affording an improvement in fuel consumption efficiency.

Fuel remains cut-off or interrupted until the engine speed Ne decreases to the lower limit of engine speed NL (1,000 rpm) of the hysteresis region, and the interruption of fuel supply is released when the engine speed Ne decreases below the lower limit of engine speed NL (1,000 rpm) of the hysteresis region so as to resume the supply of fuel again. Thereafter, fuel remains supplied even if the engine speed Ne increases above the lower limit of engine speed NL and until it reaches the upper limit of engine speed NH (1,600 rpm) of the hysteresis region. Then, the interruption of fuel supply is resumed again after an increase in engine speed above the upper limit of engine speed NH (1,600 rpm) of the hysteresis region.

Furthermore, under very low speed running conditions in which the engine 1 does not develop a noticeable increase in speed and is operating between the upper and lower limits of engine speed NH and NL of the hysteresis region while the injector 13 has been activated to supply fuel, when the accelerator pedal is completely released, and as a result, the engine 1 begins to decelerate, then, the interruption of fuel supply is forcibly conducted even in the region in which the engine 1 is by nature supplied with fuel and is maintained until the engine speed Ne decreases below the lower limit of engine speed NL of the hysteresis region. Consequently, because the compulsory interruption of fuel supply takes place even in the region of engine operating conditions in which the supply of fuel is by nature effected, a great improvement of the efficiency of fuel consumption is realized.

With the fuel control system according to the present invention featured by the interruption of fuel supply which takes place with hysteresis during deceleration, when deceleration of the engine is detected in the state in which fuel is by nature supplied in the hysteresis range, a compulsory interruption of fuel supply takes place. Consequently, the interruption of fuel supply takes place, for example, when the engine decelerates even while the vehicle is running at very low speeds with a less increase in engine speed, so as to provide an effective improvement of the efficiency of fuel consumption.

It is to be understood that although the present invention has been described in detail with respect to a preferred embodiment thereof, various other embodiments and variants may occur to those skilled in the art, which fall within the scope and spirit of the invention. Such other embodiments and variants are intended to be covered by the following claims.

What is claimed is:

1. A fuel control system, having fuel supply means for supplying a fuel to an automobile internal combustion engine, which causes said fuel supply means to continue an interruption of fuel supply during a continuous decrease in rotational speed of said engine to a lower limit of a hysteresis range of engine speeds for said interruption of fuel supply and to resume said interruption of fuel supply after a continuous increase in engine speed of said engine beyond an upper limit of said hysteresis range of engine speeds, said fuel control system comprising:

an engine speed sensor for detecting a rotational speed of said engine;

a transition sensor for detecting a transition of said engine between deceleration and non-deceleration; and control means for causing compulsorily said fuel supply means to interrupt fuel supply to said engine when said transition sensor detects a transition of said engine from non-deceleration to deceleration while said engine speed sensor detects rotational speeds of said engine between said lower and upper limits of said hysteresis range of rotational speeds.

2. A fuel control system as claimed in claim 1, wherein said transition sensor comprises a position sensor for detecting a transition between depressed and released positions of an accelerator pedal.

3. A fuel control system as claimed in claim 1, wherein said a transition sensor comprises a position sensor for detecting a transition between idle and non-idle positions of an engine throttle valve.

4. A fuel control system as claimed in claim 1, wherein said control system further detects a transition of rotational speed of said engine from under to above said lower limit of said hysteresis range of rotational speeds and causes said fuel supply means to interrupt fuel supply to said engine when said engine speed sensor detects rotational speeds of said engine greater than said lower limit of said hysteresis range of rotational speeds after having detected said transition of said rotational speed of said engine.

* * * * *